United States Patent [19]

McGurty

[11] 4,385,934

[45] May 31, 1983

[54] AUSTENITIC IRON ALLOYS HAVING YTTRIUM

[76] Inventor: James A. McGurty, 6501 Ridge Rd., Cincinnati, Ohio 45213

[21] Appl. No.: 393,852

[22] Filed: Jun. 30, 1982

Related U.S. Application Data

[63] Continuation-in-part of Ser. No. 32,617, Apr. 23, 1979, abandoned.

[51] Int. Cl.[3] ..... C22C 38/06

[52] U.S. Cl. ..... 75/124 F; 75/125; 75/128 E

[58] Field of Search ..... 75/124 F, 124 R, 128 R, 75/128 A, 128 E, 125

[56] References Cited

U.S. PATENT DOCUMENTS

| | | | |
|---|---|---|---|
| 3,754,898 | 8/1973 | McGurty | 75/124 FC |
| 4,086,085 | 4/1978 | McGurty | 75/122 |
| 4,141,762 | 2/1979 | Yamaguchi et al. | 75/128 A |
| 4,204,862 | 4/1980 | Kado et al. | 75/128 E |
| 4,261,767 | 4/1981 | Davidson | 75/122 |

*Primary Examiner*—L. Dewayne Rutledge
*Assistant Examiner*—Debbie Yee
*Attorney, Agent, or Firm*—Lawrence I. Field

[57] ABSTRACT

The presence of yttrium and/or related rare earth elements in amounts ranging from a positive amount to up to but not including 0.1% by weight in alloys described in U.S. Pat. No. 4,086,085 issued Apr. 25, 1979 significantly improves the hot workability and resistance to grain growth of said alloys.

7 Claims, No Drawings

AUSTENITIC IRON ALLOYS HAVING YTTRIUM

This application is a continuation-in-part of U.S. patent application Ser. No. 032,617 filed Apr. 23, 1979 now abandoned.

This invention is directed to improvement on the alloys described in U.S. Pat. No. 4,086,085 issued Apr. 25, 1978. More particularly it relates to alloys containing a positive amount of yttrium and/or related rare earth metals up to but not including 0.1%. The alloys of this invention are superior to the alloys of U.S. Pat. No. 4,086,085 by reason of this small yttrium content in that they have significantly improved resistance to grain growth and improved hot workability. The improved workability is attributable to the scavenging effect which the yttrium additions have on inevitable impurities in steel alloys which adversely affect hot workability and to the better workability of relatively fine grain austenitic structures.

The alloys of this invention relate to ductile, oxidation resistant austenitic iron alloys which exhibit excellent strength at high temperatures and whose oxidation resistance is based on the formation of an aluminum oxide protective film when exposed to oxidizing environments at high temperatures. More particularly, this invention relates to alloy compositions of iron, nickel, chromium, aluminum, and small amounts of yttrium and/or related rare earth metals to which may be added manganese, copper, carbon and/or nitrogen to minimize the nickel content required to obtain austenitic stability, and/or molybdenum, tungsten, columbium, tantalum, titanium, zirconium, hafnium, carbon and/or nitrogen to obtain improved high temperature strength. The excellent workability and ductility of these alloys relates to the fact that they are fully austenitic by virtue of the balancing of the alloying constituents which assures that the alloys contain no delta-ferrite.

In an earlier issued U.S. Pat. No. 3,754,898 issued Aug. 28, 1973, I have described austenitic iron-nickel-chromium-aluminum-yttrium base alloys of yttrium contents of 0.1 to 5%. The yttrium content of these earlier disclosed alloys serves to provide the alloys with greatly improved oxidation resistance at temperatures above 1700° F. The high levels of yttrium required to obtain desirable improvements in oxidation resistance are realized with preferred yttrium additions in the range of 0.5 to 1.0%. The presence of such quantities of yttrium adds substantially to the cost of the alloy and requires certain precautions in the melting of the alloys, in order to avoid the loss of the yttrium by oxidation. Further, the presence of this element is deleterious to the otherwise good hot workability of the alloys at the higher temperatures used to work stainless steel alloys. The alloys of the present invention which contain lower yttrium contents do not require expensive melting precautions and the low yttrium content of these alloys has a benign effect on the hot workability by scavenging from the alloy impurities which adversely affect hot workability, in particular sulfur which is a common impurity in iron alloys.

While not wishing to be bound by any specific theory, the effects of smaller yttrium additions on the iron-nickel-chromium-aluminum base alloys of this invention and the effects of greater amounts of yttrium on the alloy of U.S. Pat. No. 3,754,893 is believed to be as follows, based on laboratory evaluations which have continued over the years, since my pioneering work on the effects of yttrium addition on ferritic iron base alloys (U.S. Pat. Nos. 2,994,604; 3,002;833; 3,017,265; 3,027,252) austenitic iron base alloys (U.S. Pat. No. 3,754,898), nickel base alloys (U.S. Pat. No. 3,970,449) and chromium base alloys (U.S. Pat. Nos. 3,015,559; 2,955,937 and 3,347,667).

The unique properties of yttrium on the metallurgical and chemical (oxidation resistance) properties of these alloy systems is attributable to a combination of chemical properties and metallurgical properties which are unique for achieving the valuable properties advantages for these alloy systems. The rare earth elements which are also effective in this regard, are generally not as good as yttrium for achieving optimum chemical and metallurgical advantages.

The unique property of yttrium which contributes most to the special property advantages which yttrium has on iron, nickel, and chromium base alloy systems is its high chemical affinity for oxygen. Yttrium has the highest affinity for oxygen of any element at temperatures below 1600° C. Not only is $Y_2O_3$ the most stable oxide in this temperature range, but additionally, yttrium forms solid solutions with oxygen which are even more stable. In this regard, yttrium resembles titanium in which oxygen has extensive solid solubility. It is because of this special affinity for oxygen, that titanium additions to metals such as silver provide alloys which wet oxides and so provide brazing alloys which can be used to join metals to ceramics. In the case of the yttrium additions to iron base alloys, the effect of a similar wetting capability is to increase the strength of the bond between the protective oxide films which forms on these alloys at elevated temperatures and the base metals. The aluminum oxide and chroium oxide protective films which form on these alloys at elevated temperatures are normally subject to spalling under conditions of thermal cycling. As a consequence of the increased bond strength between the protective films and the base metals provided by yttrium additions, alloys such as those of U.S. Pat. No. 3,754,898 are characterized as having protective oxide films which are non-spalling. For this reason the yttrium containing alloys are found to have markedly superior oxidation resistance at temperatures above 1700° F. as compared to yttrium free alloys.

Using available technology, investigators have been unable to identify yttrium oxide as a component of the aluminum oxide or chromium oxide films which protect these iron base alloys. However, the greatly improved bond strength between the protective films and the base metals which yttrium additions to these alloys produces, is probably related to the formation of strengthening yttrium oxygen transition phase film at the interface which is so thin that it has not been detected using technology which has been available.

In the case of titanium containing brazing alloys which wet both metals and ceramics, relatively high titanium contents are required to obtain the desirable ceramic wetting property. Because of the much greater affinity of yttrium for oxygen, much lower yttrium contents are required in iron base alloys to strengthen the interface bond between bare metals and chromium oxide or aluminum oxide protective films. In the case of the alloys of U.S. Pat. No. 3,754,898, a yttrium addition of over 0.5% is required to obtain grain boundary strength improvement such that the oxide protective film becomes non-spalling under conditions of thermal cycling from elevated temperatures. Alloys which contain less than 0.1% yttrium show no advantage in this regard. Thus, the alloys of the invention of this application differ decisively from those of U.S. Pat. No. 3,754,898.

The addition of yttrium in amounts which characterize, the highly oxidation resistant, non-spalling alloys of U.S. Pat. No. 3,754,898 is certainly costly. Yttrium is a rare and expensive element whose addition to the preferred alloy compositions of U.S. Pat. No. 4,086,085 significantly increases raw material costs. Of equal negative impact is the need to use special melting methods such as vacuum or inert gas melting to minimize losses of the highly reactive yttrium content from the melt. In addition to this cost penalty, the levels of yttrium required to obtain non-spalling protective oxide film properties are found to have an adverse affect on the hot workability of the base metal alloys. In the case of ferritic base alloys, the adverse affect of yttrium on hot workability severely limits the usefulness of the alloys. The ferritic Fe-Cr-Al-Y alloys of my invention (U.S. Pat. No. 3,027,252) as well as the related Wukusick alloys (U.S. Pat. No. 3,298,826) which were developed under my direction have found only limited commercial use because large cast ingots of these alloys are hot workable only by extrusion. The alloys are rendered unworkable by hot rolling or forging as a consequence of the yttrium additions.

Fortunately, the austenitic Fe-Ni-Cr-Al-Y base alloys of my invention, U.S. Pat. No. 3,754,898 are not too seriously limited by the yttrium additions and these alloys can be hot rolled and hot forged. However, the hot workability of the yttrium bearing alloys is inferior to otherwise similar non-yttrium bearing alloys. Additionally, the temperature range for working the yttrium bearing alloys is substantially limited as compared to the temperature range for working non-yttrium bearing alloys. The work of Beltran, U.S. Pat. No. 4,144,380 has recently confirmed my findings in this regard.

The adverse effect of yttrium on the hot workability of the austenitic alloys is attributable to the fact that yttrium forms the intermetallic compound $Fe_{17}Y_2$. This compound forms a eutectic with Fe which melts at approximately 1350° C. As a consequence of the nickel and aluminum contents of the alloys of U.S. Pat. No. 3,754,898, the yttrium intermetallic compounds formed have lower melting points than the iron yttrium binary compound due to alloying effects of the nickel and aluminum contents of the alloys. Because of the presence of these yttrium phases in the austenitic alloys of U.S. Pat. No. 3,754,898, the alloy is best worked at a more restrictive, lower temperature range than that used to work otherwise similar non-yttrium bearing alloys. When a steel alloy must be worked under restrictive temperature and rolling schedules, rejection rates are bound to be high and costs adversely affected.

The yttrium phase which forms in the ferritic Fe-Cr-Al-Y alloys of U.S. Pat. No. 3,298,826 and the austenitic Fe-Ni-Cr-Al-Y base alloys of U.S. Pat. No. 3,754,898 is found metallographically to be a fine, uniform, rounded particle dispersion in the base metal matrix. The solubility of yttrium in the matrix is relatively small since growth of the dispersed phase particles is not rapid at temperatures of 1800° F. to 2100° F. Obviously, the yttrium content of the matrix solid solution, although small, is adequate for strengthening the protective film-base metal interface. Metallographic examinations of specimens heated for 1000 hours at 2000° F. show a depletion of the dispersed phase in the matrix adjacent to the surface of the metal. Additionally, some nitrogen is detected in residual dispersed phase. Thus, the dispersed phase acts as a reservoir to supply yttrium to the matrix to replace yttrium lost from the matrix by reason of oxide film reactions and the dispersed phase further acts to remove from the matrix slight traces of nitrogen which have penetrated into the alloy through defects in the oxide protective film. If it were not for this nitrogen scavenging effect of the yttrium, the nitrogen content of the matrix would increase to a level at which aluminum nitride would form. The formation of significant amounts of aluminum nitride in these alloys has a catastrophic effect on the oxidation resistance of these alloys in that the effective aluminum content of the alloy is lowered to a level which will not support aluminum oxide film formations. Under such conditions, the protective qualities of the protective film are lost.

The yttrium dispersed phase is thus found to be essential for obtaining an oxide film which is non-spalling at temperatures above 1700° F., but deleterious as regards hot workability. As the yttrium content of the alloys decrease, the amount of dispersed phase decreases and the workability of the alloy improves. The austenitic Fe-Ni-Cr-Al-Y alloys of U.S. Pat. No. 3,754,898 which contain the minimum 0.1% yttrium content of the extended composition range have only a slight oxidation resistance advantage as compared to the non-yttrium bearing alloys of U.S. Pat. No. 4,086,085, but good hot workability as compared not only to the higher yttrium content alloys of the preferred composition range, but also as compared to the non-yttrium bearing alloys. This finding suggested that yttrium additions of less than 0.1% would be useful for improving the hot workability and metallurgical stability of the Fe-Ni-Cr-Al-Y austenitic alloys of U.S. Pat. No. 4,086,085.

The advantages of small additions of yttrium for improving the hot workability of the austenitic Fe-Ni-Cr-Al-Y alloys of U.S. Pat. No. 4,086,085 is attributable to the high affinity of yttrium for the interstitial impurities in steel such as oxygen, sulfur, phosphorus and hydrogen. Of these interstitial impurities, sulfur and phosphorus impurities are particularly damaging to nickel containing austenitic iron base alloys because they form very stable phases with nickel which are liquid well below the hot rolling temperatures used to work these alloys. Such liquid phases are of course highly deleterious to the hot workability of the alloy. The addition of small amounts of yttrium to these alloys converts these sulfur and phosphorus impurities to the refractory yttrium sulfide and yttrium phosphide compounds which for the most part are flushed out of the melt. The resulting scavenged alloy is found to have excellent hot workability.

The addition of small amounts of yttrium to the Fe-Ni-Cr-Al-Y alloys is also effective for reducing grain growth at elevated temperatures. Grain growth is a serious problem facing the producers of austenitic stainless steels. Grain growth of these alloys is rapid at hot rolling and annealing temperatures and all too frequently grain growth is excessive and a rougher surface referred to as an "orange peel" effect is produced which is cause for rejection. Since these austenitic alloys cannot be grain refined by heat treating, final guage strip which has developed an orange peel surface can only be scrapped and remelted.

I have found that the addition of a positive amount of yttrium up to but not including 0.100% is significantly effective for improving the hot workability and for grain growth resistance of the austenitic Fe-Ni-Cr-Al-Y alloys of U.S. Pat. No. 4,086,085 which form an aluminum oxide type protective film. The potent effect of very small amounts of yttrium on the workability and grain growth is not unique. The addition of boron and zirconium in amounts well below 0.1% is common practice to improve the workability of nickel base alloys. My own research which is documented in part in U.S. Pat. No. 3,970,449 shows that the addition of less than 0.2% yttrium to nickel beryllium alloys provides alloys which have excellent hot workability by rolling. Equivalent alloy which contains no yttrium is unworkable by hot rolling.

Evaluations of the hot workability of the alloys of this invention were made using 2"×4"×12" rectangular ingots produced from 30-pound induction melted heats.

The Fe-20%Ni-15% Cr-4½%Al-0.05%Y alloy and the Fe-15%Ni-15%Cr-5%Mn-4%Al-0.05%Y alloy were produced using high purity electrolytic iron and manganese, carbonyl nickel, aluminothermic chromium, and ingot aluminum (99.99) and yttrium. The iron, nickel, chromium and manganese were melted under a hydrogen protective cover gas. The aluminum and yttrium additions were made after the cover gas was changed to argon and sufficient time was allowed for removal of dissolved hydrogen from the melt. The melts were cast into a steel mold using a tundish.

The ingots were cropped and then conditioned by milling the surfaces of the casting to a depth of ⅛". The few casting imperfections which remained after milling were removed by spot grinding.

After conditioning, the ingots were soaked at 2000° F. for two hours and then hot rolled taking 10% reductions per pass, with intermittent stress relieving at 2000° F. for 15 minutes after 3 passes for a 30% reduction between stress relieving heat treatments. The 1¾ inch thick billets were thus reduced to ¼" strip in sixteen 10% reduction passes with five 15-minute intermediate stress relieving heat treatments. The ¼" strip obtained was of excellent condition, free of edge cracks or surface checking.

The yttrium free Fe-20%Ni-15%Cr-4½%Al alloy and the yttrium free Fe-15%Ni-15%Cr-5%Mn-4%Al alloy described in Claims 1 and 4 of U.S. Pat. No. 4,086,085, when hot rolled according to this same hot rolling schedule were found to develop edge cracking, to the extent that yield was reduced by approximately 30%. However, these same alloys when subjected to the same series of reductions with a stress relieving heat treatment after each 20% reduction (2 passes), showed no evidence of edge cracking after reduction to ¼ inch strip.

These experimental results demonstrate the beneficial effect of 0.05% yttrium addition on the hot workability of the austenitic Fe-Ni-Cr-Al alloys according to the teachings of the present invention.

The compositional limits for defining the iron base alloys of this invention which possess the required austenite stability and aluminum oxide type protective film oxidation resistance may be generally defined as from about 16 to 45 w/o nickel, 4 to 25 w/o chromium, 3.5 to 5.5 w/o aluminum and a positive amount up to but not including 0.1 w/o yttrium. A more preferred compositional range of alloys contain 18 to 35 w/o nickel, 10–20 w/o chromium, 4 to 5 w/o aluminum and 0.04 to 0.06 w/o yttrium.

For economic reasons it is for some applications desirable to lower the nickel content of some of the alloys of this invention below the 16 w/o minimum of the Fe-Ni-Cr-Al-Y base composition of this invention. It has been found that the content of strategic and expensive nickel can be lowered to below 16 w/o without loss of austenite stability by the addition to the alloy of manganese, copper, carbon and/or nitrogen. The following have been found to be useful compositions according to the present invention for those alloys in which a partial substitution for the nickel content of the alloy is made using other less costly austenite stabilizing elements: 8–45 w/o Ni, 4–25 w/o Cr, 3.5–5.5 w/o Al, 0–20 w/o Mn, 0–0.5 w/o C, 0–0.5 w/o N, and 0–1 w/o Cu, balance essentially iron, except for the presence of a positive amount up to but not including 0.1% of Y or other rare earth elements.

Additions of carbon, nitrogen, molybdenum, tungsten, columbium, tantalum, titanium and zirconium are similarly effective for substantially improving the high temperature strength properties of the Fe-Ni-Cr-Al-Y base alloys of this invention. The compositional limits which define the useful high temperature strength alloys of this invention which have improved hot workability and metallurgical stability because of their small yttrium content may generally be defined as from about 8 to 45 w/o Ni, 4 to 25 w/o Cr, 3.5 to 5.5 w/o Al, a positive amount up to but not including 0.1 w/o Y, 0 to 20 w/o Mn, 0 to 1 w/o Cu, 0 to 10 w/o W and/or Mo, 0 to 5 w/o Cb and/or Ta, Ti, Zr, Hf, and 0 to 0.5 w/o carbon and/or nitrogen, balance essentially iron.

Although the present invention has been described in preferred embodiments, it is to be understood that modifications and variations may be resorted to without departing from the spirit and scope of the invention as those skilled in the art will readily understand. Thus, the alloys of this invention may also contain small amounts of silicon and/or tellurium, either as impurities or as intentionally added elements, provide deliberately to afford some specific property or properties. The alloy may contain small amounts of expensive cobalt, for example; added as a partial substitution of nickel, without departing from the intended scope of the inventions. Furthermore, while the foregoing description has emphasized the advantages of the addition of small amounts of yttrium to the austenitic alloys described, the invention may be practiced by the use of rare earth elements such as cerium, lanthanum and other rare earth elements in place of all or only a part of the yttrium addition. Such modifications and variations are considered to be within the purview and scope of the invention and appended claims.

The alloys of the present invention are critically different from the alloys described in U.S. Pat. No. 4,204,862 in that they contain no delta ferrite. I have found that the presence of even minute amounts of delta ferrite adversely affect the hardness and workability at ambient temperatures to the extent that their usefulness for applications in which austenitic alloys are required is compromised. The presence of any delta ferrite is readily detectable by simple tests known to those skilled in the art. For example, small amounts of delta ferrite render the alloys magnetic and is readily detectable.

The alloys of the present invention are also critically different from the iron base alloys described in U.S. Pat. No. 4,261,767 which contain large amounts of delta ferrite and are hard, brittle alloys which have very poor cold workability.

By contrast, the austenitic alloys of the present invention which are free of delta ferrite exhibit the following properties: (1) they are non-magnetic; (2) they are cold workable at ambient temperatures; (3) on cold working they do not exhibit large cold-work hardening; (4) their low hardness is typical of the austenitic stainless steels of commerce; and, finally, (5) they form the protective aluminum oxide type oxide film when exposed to oxidizing atmospheres at elevated temperatures.

Having now described my invention, it is not intended that it be limited except as required by the appended claims.

What is claimed is:

1. In a workable, high temperature austenitic nickel, chromium, aluminum iron-base alloy in which the nickel, chromium and aluminum contents are balanced to insure that the alloy is austenitic and is an alloy which forms an aluminum oxide film which is protective of the base metal to 1700° F. in air, said alloy consisting essentially of 18.0 to 35.0 weight percent of nickel, 10.0 to 20.0 weight percent of chromium, 4.0 to 5.0 weight percent aluminum, and the balance consisting essentially of iron, and the improvement in said alloy which consists in including in said alloy from 0.04 to 0.06 weight percent of yttrium to obtain improved hot workability and resistance to grain growth, as compared with an otherwise similar alloy which is free from yttrium, said alloy being austenitic by virtue of the balancing of said alloying constituents and containing no delta ferrite.

2. In a workable, high temperature, austenitic nickel, chromium, aluminum, iron-base alloy consisting essentially of 16.0 to 45.0 weight percent of nickel, 4.0 to 25.0 weight percent of chromium, 3.5 to 5.5 weight percent of aluminum and the balance consisting essentially of iron, the content of said nickel, chromium, iron, and aluminum in said alloy being balanced so as to insure that the alloy is austenitic and is an alloy which forms an oxide film consisting of aluminum oxide when said alloy is exposed to an oxidizing environment at elevated temperatures up to 1700° F. the improvement in said alloy which consists in including in said alloy a positive amount of up to but not including 0.1 weight percent of yttrium to obtain improved hot workability and resistance to grain growth, as compared with an otherwise similar alloy which is free from yttrium, said alloy being austenitic by virtue of the balancing of said alloying constituents and containing no delta ferrite.

3. In a workable, high temperature, austenitic iron-base alloy consisting essentially of 8.0 to 45.0 weight percent nickel, 4.0 to 25.0 weight percent chromium, 3.5 to 5.5 weight percent aluminum and containing 0 to 20.0 weight percent manganese, 0 to 0.5 weight percent carbon, 0 to 0.5 weight percent nitrogen, and 0 to 1 weight percent copper with the balance consisting essentially of iron, the composition of the constituents in said alloy being balanced so as to insure that the alloy is austenitic and is an alloy which forms an oxide film consisting of aluminum oxide when said alloy is exposed to an oxidizing environment at elevated temperatures up to 1700° F., said film being protective of said alloy to 1700° F., the improvement in said alloy which consists in including in said alloy a positive amount up to but not including 0.1 weight percent of yttrium to obtain improved hot workability and resistance to grain growth, as compared with an otherwise similar alloy which is free from yttrium, said alloy being austenitic by virtue of the balancing of said alloying constituents and containing no delta ferrite.

4. In a workable, high temperature, austenitic iron-base alloy consisting essentially of 8.0 to 45.0 weight percent nickel, 4.0 to 25.0 weight percent chromium, 3.5 to 5.5 weight percent aluminum, and containing 0 to 20.0 weight percent manganese, 0 to 0.5 weight percent carbon, 0 to 0.5 weight percent nitrogen, as a partial substitution of the austenite stabilizing nickel content and the following for increasing high temperature strength: 0 to 10.0 weight percent tungsten, 0 to 10.0 weight percent molybdenum, and 0 to 5.0 weight percent of at least one element selected from the group consisting of columbium, tantalum, titanium, zirconium, and hafnium, the balance consisting essentially of iron, the composition of the constituents in said alloy being balanced to insure that the alloy is austenitic and is an alloy which forms an aluminum oxide film when said alloy is exposed to an oxidizing environment at elevated temperatures up to 1700° F., said film being protective of said alloy to 1700° F., the improvement in said alloy which consists in providing in said alloy a positive amount up to but not including 0.1 weight percent yttrium to obtain improved hot workability and resistance to grain growth, as compared with an otherwise similar alloy which is free from yttrium, the constituents in said alloy being balanced so that said alloy is austenitic and contains no delta ferrite.

5. In a workable, high temperature, austenitic iron-base alloy which forms an aluminum oxide film which is protective of the base metal to 1700° F. in air cooling essentially of 18 to 35 weight percent nickel, 10 to 20 weight percent chromium, 4 to 5.5 weight percent aluminum and containing 0 to 20 weight percent manganese, 0 to 0.5 weight percent carbon, 0 to 0.5 weight percent nitrogen, and 0 to 1.0 weight percent copper with the balance consisting essentially of iron, the improvement in said alloy which consists in providing in said alloy a positive amount up to but not including 0.1 weight percent yttrium to obtain improved hot workability and resistance to grain growth, as compared with an otherwise similar alloy which is free from yttrium, the constituents in said alloy being balanced so that said alloy is austenitic and contains no delta ferrite.

6. In a workable, high temperature, austenitic iron-base alloy which forms an aluminum oxide film which is protective of the base metal to high temperatures up to about 1700° F. in air consisting essentially of 18 to 35 weight percent nickel, 10 to 20 weight percent chromium, 4 to 5.5 weight percent aluminum, and containing 0 to 20.0 weight percent manganese, 0 to 0.5 weight percent carbon, 0 to 0.5 weight percent nitrogen as a partial substitution for the austenite stabilizing nickel content and the following for increased high temperature strength: 0 to 10.0 weight percent tungsten, 0 to 10.0 weight percent molybdenum, and 0 to 5.0 percent of at least one element selected from the group consisting of columbium, tantalum, titanium, zirconium, and hafnium, the balance consisting essentially of iron, the improvement in said alloy which consists in providing in said alloy a positive amount up to but not including 0.1 weight percent yttrium to obtain improved hot workability and resistance to grain growth, as compared with an otherwise similar alloy which is free from yttrium, the constituents in said alloy being balanced so that said alloy is austenitic and contains no delta ferrite.

7. A high temperature austenitic alloy according to any of claims 1–6 in which at least a portion of the yttrium is replaced by a rare earth element.

* * * * *